US006514924B1

(12) United States Patent
Van Hauwermeiren et al.

(10) Patent No.: US 6,514,924 B1
(45) Date of Patent: Feb. 4, 2003

(54) BLEACH CONTAINING COMPOSITIONS FOR STAIN REMOVAL AND METHODS OF HEAT ACTIVATION OF THE BLEACH

(75) Inventors: Tim Maria Joris Van Hauwermeiren, Ramsdonk (BE); Michael Peter Siklosi, Cincinnati, OH (US); Sonia Gaaloul, Brussels (BE); Ann Vandevenne, Putte (BE)

(73) Assignee: Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/807,152

(22) PCT Filed: Oct. 13, 1999

(86) PCT No.: PCT/US99/24023

§ 371 (c)(1),
(2), (4) Date: Apr. 9, 2001

(87) PCT Pub. No.: WO00/23646

PCT Pub. Date: Apr. 27, 2000

Related U.S. Application Data

(60) Provisional application No. 60/105,253, filed on Oct. 22, 1998.

(51) Int. Cl.[7] ..... C11D 3/395; D06F 43/00

(52) U.S. Cl. ..... 510/284; 510/297; 510/303; 8/137

(58) Field of Search ..... 510/284, 297; 8/137

(56) References Cited

U.S. PATENT DOCUMENTS 5,630,847 A * 5/1997 Roetker ..... 8/137
5,762,648 A * 6/1998 Yeazell ..... 8/137
5,789,368 A * 8/1998 You et al. ..... 510/297

FOREIGN PATENT DOCUMENTS

| | | |
|---|---|---|
| DE | 43 03 454 | 8/1994 |
| GB | 2 327 433 | 1/1999 |
| WO | WO 96/30471 | 10/1996 |
| WO | WO 97/07278 | 2/1997 |
| WO | WO 97/27354 | 7/1997 |
| WO | WO 97/41292 | 11/1997 |
| WO | WO 98/05814 | 2/1998 |
| WO | WO 98/31863 | 7/1998 |
| WO | WO 99/14421 | 3/1999 |
| WO | WO 99/46319 | 9/1999 |

* cited by examiner

*Primary Examiner*—Yogendra N. Gupta
*Assistant Examiner*—John M Petruncio
(74) *Attorney, Agent, or Firm*—C. B. Cook; K. W. Zerby; Steve W. Miller

(57) ABSTRACT

A method for treating a fabric having a discrete stained area, wherein the fabric has a first side and a second side, the method comprises the steps of: (a) applying a spot cleaning composition to the discrete stained area of the fabric; (b) contacting the first side of the fabric adjacent the stained area with an absorbent stain receiving article; (c) subjecting the second side of the fabric adjacent the stained a to a heat source; (d) optionally, concurrently or consecutively with Step (a), contacting the fabric adjacent the stained area with a treatment member; and (e) optionally, applying an aqueous rinsing solution to the fabric adjacent the stained area. The spot cleaning composition comprises a bleach, a solvent, a surfactant and water. Also provided are spot removal kits that include instructions for performing the present spot removal methods, and a process for cleaning and refreshing fabrics that can optionally be performed before or after the present spot removal methods.

7 Claims, No Drawings

BLEACH CONTAINING COMPOSITIONS FOR STAIN REMOVAL AND METHODS OF HEAT ACTIVATION OF THE BLEACH

This application claims benefit of Provisional Application No. 60/105,253 filed Oct. 22, 1998.

TECHNICAL FIELD

The present invention relates to methods for spot treating discrete stained areas of fabrics with a bleach containing composition that is activated with heat. The fabrics can be cleaned and refreshed in a non-immersion cleaning process before or after the discrete stained areas of the fabric is treated.

BACKGROUND OF THE INVENTION

Few things in life are as frustrating as noticing that your cloths are stained. But it is especially frustrating when you notice a stain on a freshly washed piece of clothing. Stain removal methods typically employ concentrated detergent compositions that, while generally good for removing stains, require that the clothes be further processed, for example, by washing, to remove the detergent composition. Therefore, a second washing cycle is often required when stains are not detected until after they have been laundered. Re-washing freshly laundered clothes, or other fabric articles, wastes valuable time and resources.

It is, of course, well known that alternating cycles of using and laundering fabrics and textiles, such as articles of worn clothing and apparel, will inevitably adversely affect the appearance and integrity of the fabric and textile items. Fabrics and textiles simply wear out over time and with use. Laundering of fabrics and textiles is necessary to remove soils and stains which accumulate therein and thereon during ordinary use. But the laundering operation itself, over many cycles, can accentuate and contribute to the deterioration of the integrity and the appearance of such fabrics and textiles.

Deterioration of fabric integrity and appearance can manifest itself in several ways. Short fibers are dislodged from woven and knit fabric/textile structures by the mechanical action of laundering. These dislodged fibers may form lint, fuzz or "pills" which are visible on the surface of fabrics and diminish the appearance of newness of the fabric. Further, repeated laundering of fabrics and textiles, especially with bleach-containing laundry products, can remove dye from fabrics and textiles and impart a faded, worn out appearance as a result of diminished color intensity, and in many cases, as a result of changes in hues or shades of color. All of these problems are exacerbated by re-washing "clean" fabrics to remove localized stains.

Moreover, after clothes and other fabric articles are washed they are often ironed to remove wrinkles that are a natural result of most fabric laundering processes. It is generally understood that the heat associated with ironing will increase the difficulty of removing most stains. That is, stains are "set" when they are ironed. And it has been shown that ironing over most stain removal compositions results in additional staining of the fabric. This additional staining is caused by the interaction of the surfactant in the stain removal composition and the heat from the iron. That is, the surfactant degrades in the presence of heat leaving behind an unsightly residue, which is typically difficult to remove. Thus, ironing a stained area of a fabric is regarded as a practice that is generally harmful to the fabric.

The problems described above are especially acute with certain fabrics, such as silk, linen, wool and other delicate fabrics that are not suitable for conventional in-home immersion cleaning processes. Consumers typically have their delicate fabric items "dry-cleaned", a process that is typically inconvenient and expensive. Hence, when a dry-cleaned fabric article must be "re-worked" to remove a residual stain, substantial cost and inconvenience are often involved.

Arguably, dry-cleaning is generally superior to in-home immersion processes for stain removal. But dry-cleaning, unfortunately, usually involves immersing the fabrics in various hydrocarbon and halocarbon solvents that require special handling and must be reclaimed, making the process unsuitable for in-home use. Hence, dry-cleaning has traditionally been restricted to commercial establishments making it less convenient and more costly than in-home laundering processes.

Attempts have been made to provide in-home dry-cleaning systems that combine the fabric cleaning and refreshing of in-home, immersion laundering processes with the fabric care benefits of dry-cleaning processes. One such in-home system for cleaning and refreshing garments comprises a substrate sheet containing various liquid or gelled cleaning agents, and a plastic bag. The garments are placed in the bag together with the sheet, and then tumbled in a conventional clothes dryer. In a current commercial embodiment, multiple single-use flat sheets comprising a cleaning/refreshing agent and a single multi-use plastic bag are provided in a package. Unfortunately, such in-home processes generally require that discreet stains be pre-treated, and if the stain is not detected until after the in-home, non-immersion process, re-work may be required.

Thus, there is a need for a stain removal method that can be performed before or after fabrics have been laundered. Preferably, the spot removal compositions used in these stain removal processes can be performed without the need for laundering the fabrics again. And even more preferably, the processes can be used on delicate fabrics and in conjunction with a fabric ironing process.

SUMMARY OF THE INVENTION

In one aspect of the present invention there is provided a method for treating a fabric having a discrete stained area, wherein the fabric has a first side and a second side, the method comprises the steps of:

(a) applying a spot cleaning composition to the discrete stained area of the fabric wherein the spot cleaning composition comprises, by weight;
  (i) from about 0.01% to about 2.5%, preferably from about 0.05% to about 2.0%, most preferably from about 0.1% to about 1.0% of a surfactant selected from the group consisting of anionic, cationic, nonionic, zwitterionic, amphoteric and mixtures thereof;
  (ii) from about 0.1% to about 4%, preferably from about 0.3% to about 3%, most preferably from about 0.5% to about 2% of a glycol ether solvent;
  (iii) from about 0.1% to about 4%, preferably from about 0.3% to about 3%, most preferably from about 0.5% to about 2% of a bleach;
  (iv) from about 91% to about 99% water;

(b) contacting the first side of the fabric adjacent the stained area with an absorbent stain receiving article;

(c) subjecting the second side of the fabric adjacent the stained area to a heat source;

(d) optionally, concurrently or consecutively with Step (a), contacting the fabric adjacent the stained area with a treatment member; and (e) optionally, applying an aqueous rinsing solution to the fabric adjacent the stained area.

It has now also been unexpectedly discovered that certain bleach containing spot removal compositions, which are substantially aqueous, can be used to treat stains on fabrics with little or no re-work required. And, even more surprisingly, it has been found that the stain removal efficacy of these compositions can be enhanced by heat, such as the heat of an iron, which activates the bleach. Thus, the present invention provides methods for treating stains, and compositions for use in these methods, that are effective for removing most stains while simultaneously reducing the amount of re-work that is necessary. While not wanting to be bound by any one theory, it is believed that the heat activated bleach can overcome the tendency of some stains to be set by heat in the absence of bleach.

Moreover, the present invention provides an in-home, non-immersion fabric cleaning and refreshing process for use in conjunction with the present stain treating methods and compositions. When using the stain treating methods, compositions, and cleaning refreshing processes of this invention the stain removal and cleaning/refreshing efficacy is comparable to, and in some cases substantially better than, commercial dry-cleaning with a solvent immersion process.

DETAILED DESCRIPTION OF THE INVENTION

In one aspect, the present invention comprises a method and a composition for treating stains on fabric articles, such as clothes and the like. This spot treating method comprises the steps of:

(a) applying a spot cleaning composition to the discrete stained area of the fabric;

(b) contacting the first side of the fabric adjacent the stained area with an absorbent stain receiving article;

(c) subjecting the second side of the fabric adjacent the stained area to a heat source;

(d) optionally, concurrently or consecutively with Step (a), contacting the fabric adjacent the stained area with a treatment member; and (e) optionally, applying an aqueous rinsing solution to the fabric adjacent the stained area.

A non-immersion cleaning/refreshment process for treating a fabric is also defined herein. The fabric can be spot treated at anytime in conjunction with the non-immersion cleaning and refreshing process of this invention, preferably the spot treatment occurs before the cleaning and refreshing step.

By "cleaning" herein is meant the removal of soils and stains from fabrics. "Spot cleaning", "spot treating" and "spot removal" are the localized cleaning on stained areas before or after the cleaning/refreshment step which is conducted in the bag. By "refreshment" herein is meant the removal of malodors and/or wrinkles from the overall fabrics, or the improvement of their overall appearance, other than primarily removing soils and stains, although some soil and stain removal can occur concurrently with refreshment. Each of the elements of this invention are described in turn below.

Spot Treating Method and Composition

The methods of the present invention are generally described above. The spot treating compositions for use in these methods preferably comprise:

(i) from about 0.01% to about 2.5%, preferably from about 0.05% to about 2.0%, most preferably from about 0.1% to about 1.0% of a surfactant selected from the group consisting of anionic, cationic, nonionic, zwitterionic, amphoteric and mixtures thereof;

(ii) from about 0.1% to about 4%, preferably from about 0.3% to about 3%, most preferably from about 0.5% to about 2% of a glycol ether solvent;

(iii) from about 0.1% to about 4%, preferably from about 0.3% to about 3%, most preferably from about 0.5% to about 2% of a bleach, which is preferably hydrogen peroxide;

(iv) from about 91% to about 99% water;

These compositions are used to treat localized stains from fabrics, either before or after the cleaning and refreshing process defined herein. Necessarily, the spot cleaning composition must be compatible with the fabric being treated. That is, no meaningful amount of dye should be removed from the fabric during the spot treatment and the spot cleaning composition should leave little or no visible residue on the fabric. Therefore, in a preferred aspect of this invention there are provided spot cleaning compositions which are substantially free of materials that leave visible residues on the treated fabrics. This necessarily means that the preferred compositions are formulated to contain the highest level of volatile materials possible, preferably water, typically about 91%, preferably at least about 97.7%, and surfactant at levels of about 0.01% to about 2.5%.

A small amount of a bleach stabilizer is preferred for use in the present invention. But some bleach stabilizers, such as citric acid, stanate, and pyrophosphate are known to have a negative impact on the stain treatment qualities of this invention. More specifically, when fabrics are treated with compositions comprising more than 0.1% of these bleach stabilizers, the stabilizer can cause an unsightly residual ring/stain to form when those fabrics are ironed. Preferably, the spot treating compositions of this invention comprise greater than 0%, but less than abut 0.1%, and more preferably less than 0.05%, by weight of a bleach stabilizer. And most preferably, the bleach stabilizer is EDTA (ethylenediaminetetracetic acid).

Preferably the compositions for use in the methods of this invention comprise a glycol ether solvent that is selected from the group consisting of methoxy propoxy propanol, ethoxy propoxy propanol, propoxy propoxy propanol, butoxy propoxy propanol, butoxy propanol and mixtures thereof. A preferred spot cleaning composition will also contain a cleaning solvent such as butoxy propoxy propanol (BPP) at a low, but effective, level, typically from about 0.1% to about 4%, preferably about 2%. Even more preferably, the spot cleaning composition further comprises an adjuvant material selected from the group consisting of perfumes, preservatives, additional organic solvents and mixtures thereof.

The surfactant for use in the present composition is preferably anionic, nonionic or mixtures thereof, and, preferably the surfactant is an ethoxylated alcohol sulfate.

The heat source required by the present invention can be any appropriate heat source, such as a conventional household appliance selected from the group consisting of hair dryers, heat lamps, irons, and mixtures thereof. The heat source is preferably capable of applying localized heat to the area adjacent the stain, as opposed to, for example, a clothes dryer, which is designed to heat an entire garment evenly. As discussed throughout this description, the present invention is directed to treating a localized stained area. Thus, clothes irons and hair dryers are all preferred for delivering heat directly to the stained area of the fabric so as to activate the bleach from the spot cleaning compositions deposited thereon.

Preferably, the heat source is a conventional clothes iron, and more preferably, the iron is capable of spraying the optional aqueous rinsing solution onto the fabric. Irons and hair dryers are known to the art and they can be purchased at appliance, hardware, and general merchandise stores. The heat source should be capable of raising the temperature of the spot cleaning solution on the surface of the fabric to a temperature of from about 70° C. to about 200° C., and preferably from about 100° C. to about 190° C.

In more detail, the spot treating methods can be conducted in the following manner. Modifications of this method can be practiced without departing from the spirit and scope of the present invention.

1. Place a stained area of the fabric over and in contact with an Absorbent Stain Receiving Article, which is preferably a white terry cloth towel, a poly-HIPE or TBAL stain receiver described herein or, less preferably, an ordinary folded paper towel (e.g., preferably white or non-printed to avoid dye transfer from the towel-BOUNTY® brand) on any suitable surface such as a table top, in a tray, etc.
2. Apply a sufficient amount of the spot cleaning composition from a dispenser bottle with a narrow spout which directs the composition onto the stain (without unnecessarily saturating the surrounding area of the fabric) to saturate the localized stained area, about 10 drops; more may be used for a larger stain.
3. Optionally, let the composition penetrate the stain for 3–5 minutes.
4. Subject the stained area to a heat source that provides sufficient heat to activate the bleach in the spot cleaning composition. The heat can be applied to the fabric by, for example, ironing the fabric at a heat setting appropriate for the fabric type, or by blowing warm air from a hair dryer over the stained area.
5. Optionally, apply additional composition, about 10 drops; more may be used for larger stains.
6. Use the treatment member, such as the distal tip on the dispenser bottle to work the stain completely out. Contact can be maintained for a period of 1–60 seconds for lighter stains and 1–5 minutes, or longer, for heavier or more persistent stains.
7. Optionally, blot the fabric, e.g., between paper towels, to remove excess composition. Or, the treated area can be blotted with a dampened sponge or other absorbent medium to flush the fibers and remove excess composition.
8. Optionally, repeat steps 2 through 7 as required to remove the stain. Before repeating the spot removal steps, the Absorbent Stain Receiving Article can be optionally replaced with a clean receiver, or moved so that a fresh area of the receiver contacts the stained area of the fabric.

Preferred spot cleaning compositions are exemplified below, and are described in U.S. Pat. No. 5,789,368, to You et al., the entire disclosure of which is incorporated herein by reference. Additionally, spot cleaning compositions are described in U.S. Pat. No. 5,630,847, which issued on May 20, 1997, to Roetker. The entire disclosure of the Roetker patent is incorporated herein by reference.

Spot Removal Kit

The present invention further provides a kit, comprising:

(a) a portion of a spot cleaning composition; and (b) one or more absorbent stain receiver articles. Preferably; the kit further comprises:

(c) multiple substrates with a liquid cleaning/refreshment composition releasably absorbed therein;

(d) a re-usable containment bag; and (e) a treatment member.

In one embodiment, the portion of the spot cleaning composition is provided in a container, and the treatment member is the tip of the container.

The kits of this invention preferably include the following instructions for use:

(i) apply the spot cleaning composition to a discrete stained area of a fabric;

(ii) contact a first side of the fabric adjacent the stained area with an absorbent stain receiving article;

(iii) subject a second side of the fabric adjacent the stained area to a heat source;

(iv) optionally, concurrently or consecutively with Step (a), contact the fabric adjacent the stained area with a treatment member;

(v) optionally, apply an aqueous rinsing solution to the fabric adjacent the stained area; and (vi) optionally, repeat steps (i) through (v) as necessary to remove the stain.

Treatment Member

In one embodiment, a treatment member is provided to assist in removing localized stains from fabrics. In a preferred aspect of this invention, the spot removal composition is provided in a dispenser, such as a bottle, and the dispenser has a distal tip that can serve as the treatment member. Additionally, the treatment member can comprise an absorbent base material which can be, for example, a natural or synthetic sponge, an absorbent cellulosic sheet or pad, or the like. In contact with and extending outward from this base material can be multiple protrusions. Specific examples of treatment members can be found in U.S. Pat. No. 5,789,368, to You et al. which was incorporated herein by reference above.

Absorbent Stain Receiving Article

An absorbent stain receiving article, sometimes referred to herein as a stain receiver, is used in the spot removal methods of this invention. Such stain receivers can be any absorbent material which imbibes the liquid composition used in the spot removal methods. Disposable paper towels, cloth towels such as BOUNTY™ brand towels, clean rags, etc., can be used. However, in a preferred mode the stain receiver is designed specifically to "wick" or "draw" the liquid compositions away from the stained area. One preferred type of stain receiver consists of a nonwoven pad, such as a thermally bonded air laid fabric ("TBAL" ). Also preferred for use herein are conventional white terry cloth towels. Another highly preferred type of stain receiver for use herein comprises polymeric foam, wherein the polymeric foam comprises a polymerized water-in-oil emulsion, sometimes referred to as "poly-HIPE". The manufacture of polymeric foam is very extensively described in the patent literature; see, for example: U.S. Pat. No. 5,260,345 to DesMarais, Stone, Thompson, Young, LaVon and Dyer, issued Nov. 9, 1993; U.S. Pat. No. 5,550,167 to DesMarais, issued Aug. 27, 1996, and U.S. Pat. No. 5,650,222 to DesMarais et al., issued Jul. 22, 1997, all incorporated herein by reference. Typical conditions for forming the polymeric foams of the present invention are described in co-pending U.S. patent application Ser. No. 09/042,418, filed Mar. 13, 1998 by T. A. DesMarais, et al., titled "Absorbent Materials for Distributing Aqueous Liquids", the disclosure of which is incorporated herein by reference. Additional disclosure of conditions for forming the polymeric foams for use in the present invention are described in co-pending U.S. Provisional Patent Application Ser. No. 60/077,955, filed Mar. 13, 1998 by T. A. DesMarais, et al., titled "Abrasion Resistant Polymeric Foam And Stain Receivers Made Therefrom", the disclosure of which is incorporated herein by reference.

The various stain receivers described herein, and described in the references incorporated herein by reference, preferably comprise a liquid impermeable backsheet. The backsheet can be made of, for example, a thin layer of polyamide, polypropylene, polyethylene and the like. The backsheet provides protection for the surface that the stain receiver rests on. For example, spot cleaning processes are typically performed on a hard surface, such as a table top or an ironing board. The stain receiver is placed on the table and the fabric to be treated in placed on the stain receiver. Spot cleaning composition is applied to the stained area of the fabric and then drawn into the stain receiver. But in the absence of a back sheet, the spot cleaning composition can leak onto the table top, possibly causing damage thereto.

Cleaning and Refreshing Processes

The stain removal methods of this invention can be conducted with an overall fabric cleaning and refreshing process. The cleaning refreshing process can be conducted before or after the spot treating methods defined herein. The steps of the fabric cleaning and refreshing process comprise:

(a) placing the fabric in a containment bag;

(b) placing a substrate in the containment bag, wherein releasably absorbed in the substrate is a liquid cleaning/refreshment composition;

(c) placing the bag in a hot air clothes dryer, or the like apparatus, and operating the apparatus with heat and tumbling; and (d) removing the fabric from the bag.

More specifically, the cleaning/refreshment composition is loaded on a substrate which is preferably encased in a coversheet, and the substrate is placed in a bag with the fabrics to be treated. The bag is closed and placed in a heated operating clothes dryer, or the like, to remove malodors from the fabrics. The warm, humid environment created inside the bag volatilizes malodor components in the manner of a "steam distillation" process, and moistens fabrics and the soils thereon. This moistening of fabrics can loosen pre-set wrinkles, without setting of new wrinkles during the drying stage toward the end of the dryer cycle. The bag is preferably vented, otherwise the volatilized malodorous materials removed from the fabrics can undesirably be redeposited thereon.

The cleaning and refreshment process is conveniently conducted in a tumbling apparatus, preferably in the presence of heat. The substrate containing the releasably absorbed shrinkage reducing composition and cleaning/refreshment composition is placed along with the fabrics to be treated in a nylon or other heat-resistant, and preferably vapor-venting bag. The bag is closed and placed in the drum of an automatic hot air clothes dryer at temperatures of 40° C.–150° C. The drum is allowed to revolve, which imparts a tumbling action to the bag and agitation of its contents concurrently with the tumbling. The tumbling and heating are carried out for a period of at least about 10 minutes, typically from about 20 minutes to about 60 minutes. This step can be conducted for longer or shorter periods, depending on such factors as the degree and type of soiling of the fabrics, the nature of the soils, the nature of the fabrics, the fabric load, the amount of heat applied, and the like, according to the needs of the user.

Cleaning/Refreshment Composition

The cleaning/refreshment composition preferably comprises water and a member selected from the group consisting of surfactants, perfumes, anti-shrinkage agents, preservatives, bleaches, auxiliary cleaning agents, organic solvents and mixtures thereof. The preferred organic solvents are glycol ethers, specifically, methoxy propoxy propanol, ethoxy propoxy propanol, propoxy propoxy propanol, butoxy propoxy propanol, butoxy propanol and mixtures thereof. Preferably, the cleaning/refreshment compositions of this invention further comprise an anti-shrinkage agent selected from the group consisting of ethylene glycol, all isomers of propanediol, butanediol, pentanediol, hexanediol and mixtures thereof, and more preferably selected from the group consisting of neopentyl glycol, polyethylene glycol, 1,2-propanediol, 1,3-butanediol, 1-octanol and mixtures thereof. Especially preferred for use in the cleaning refreshment compositions of this invention are neopentyl glycol or 1,2-propanediol, and is more preferably 1,2-propanediol. The surfactant is preferably a nonionic surfactant, such as an ethoxylated alcohol or ethoxylated alkyl phenol, and is present at up to about 2%, by weight of the cleaning/refreshment composition. Typical fabric cleaning refreshment/compositions herein can comprise at least about 80%, by weight, water, preferably at least about 90%, and more preferably at least about 95% water.

The Examples below give specific ranges for the individual components of preferred cleaning/refreshment compositions for use herein. A more detailed description of the individual components of the cleaning/refreshment compositions, that is, the organic solvents, surfactants, perfumes, anti-shrinkage agents, preservatives, bleaches and auxiliary cleaning agents can be found in U.S. Pat. No. 5,789,368, which issued on Aug. 4, 1998 to You et al. The entire disclosure of the You et al. patent was incorporated herein by reference above. Additionally, cleaning/refreshment compositions are described in co-pending U.S. patent application Ser. No. 08/789,171, which was filed on Jan. 24, 1997, in the name of Trinh et al. The entire disclosure of the Trinh et al. Application is incorporated herein by reference.

Substrate

When used in the in-dryer step of the present process, the cleaning/refreshment composition is used in combination with an absorbent substrate, herein after referred to as a "substrate". The substrate releasably contains the compositions. By "releasably contains" means that the compositions are effectively released from the substrate onto the soiled fabrics as part of the non-immersion cleaning and fabric refreshment processes herein. This release occurs mainly by volatilization of the composition from the substrate through the vapor-permeable coversheet, or by a combination of vapor and liquid transfer, although bulk liquid transfer is desirably minimized by means of the coversheet herein.

The substrate can be in any desired form, such as powders, flakes, shreds, and the like. However, it is highly preferred that the substrate be in the form of an integral pad or "sheet" that substantially maintains its structural integrity throughout the process. The substrates and sheets of this invention are sometimes referred to in the literature as "carriers" or "absorbent carrier sheets"; it is understood that all of these labels refer to liquid absorbing materials that can be used to conveniently transport liquids. Such substrates are described in detail in U.S. Pat. No. 5,789,368, to You et al. which was incorporated herein by reference above. The manufacture of these sheets forms no part of this invention and is already disclosed in the literature. See, for example, U.S. Pat. No. 5,009,747, Viazmensky, et al., Apr. 23, 1991 and U.S. Pat. No. 5,292,581, Viazmensky, et al., Mar. 8, 1994, which are incorporated herein by reference.

The substrate is intended to contain a sufficient amount of the shrinkage reducing composition and cleaning/refreshment compositions to be effective for their intended purpose. The capacity of the substrate for such compositions will vary according to the intended usage. The size of the substrate should not be so large as to be unhandy for the user. Typically, the dimensions of the substrate will be sufficient to provide a macroscopic surface area (both sides of the substrate) of at least about 360 $cm^2$, preferably in the range from about 360 $cm^2$ to about 3000 $cm^2$. For example, a generally rectangular substrate may have the dimensions (X-direction) of from about 10 cm to about 35 cm, and (Y-direction) of from about 18 cm to about 45 cm.

Coversheet

The coversheets employed herein are distinguished from the substrate, inasmuch as the coversheets are relatively non-absorbent to the shrinkage reducing compositions and cleaning/refreshment compositions as compared with the substrate. The coversheets are constructed from hydrophobic fibers which tend not to absorb, "wick" or otherwise promote the transfer of fluids. While fluids can pass through the void spaces between the fibers of the coversheet, this occurs mainly when excessive pressure is applied to the article. Thus, under typical usage conditions the coversheet provides a physical barrier which keeps the absorbent substrate, which is damp from its load of shrinkage reducing composition and cleaning/refreshment composition, from coming into direct contact with the fabrics being treated. Yet, the coversheet does allow vapor transfer of the shrinkage reducing composition and cleaning/refreshment composition from the substrate through the coversheet and into the containment bag, and thus onto the fabrics being treated. If desired, the coversheet can be provided with macroscopic fenestrations through which the lint, fibers or particulate soils can pass, thereby further helping to entrap such foreign matter inside the article, itself.

Such fibrous, preferably heat resistant and, most preferably, hydrophobic, coversheets are described in detail in U.S. Pat. No. 5,789,368, to You et al. which was incorporated herein by reference above. Additionally, co-pending U.S. provisional application No. 60/077,556, which was filed on Mar. 11, 1998, in the name of Wise et al., describes certain improvements to the coversheets of this invention. The entire disclosure of the Wise et al. application is incorporated herein by reference. Suitable combinations of the coversheets described in You et al. with the improvements described in Wise et al. can be employed, according to the desires of the manufacturer, without departing from the spirit and scope of the invention.

One potential problem with the sheets of this invention, that is the substrate or the combination of a substrate and a coversheet, is that they may be overused by the consumer. The sheets are typically provided with enough shrinkage reducing composition and cleaning/refreshment composition for one use. If after the first use the sheet looks clean, the consumer may be inclined to reuse it. Reusing a sheet that contains an insufficient amount of shrinkage reducing composition and cleaning/refreshment composition will generally be ineffective. Thus, an indicator, such as a dye that changes color, can be added to either of the substrate or the coversheet. The indicator will alert the consumer that the sheet has been used and should be discarded. Preferably, the indicator changes the sheet color to yellow, brown or gray.

In the Wise et al. reference incorporated herein above, a different, yet equally effective solution to this problem is proposed. Specifically, a tackiness agent is applied to the sheet. The tackiness agent attracts and collects loose fibers, hair, lint and other stray matter from the fabrics being treated. This not only serves to remove these undesirable items from the fabrics, it serves as an indicator as well. At the end of the treatment process the stray material that becomes affixed to the sheet gives the sheet a "dirty" appearance, signaling the consumer to throw the sheet away.

Containment Bag

The present invention provides a non-immersion cleaning and refreshing process that is carried out in a containment bag. The process herein can be conducted in a sealed bag, but in a highly preferred mode, the process of the present invention employs a vapor-venting containment bag. The bag is preferably designed for multiple uses and reuses, and is especially adapted for use by the consumer in most conventional hot air clothes dryer apparatus, such as those found in the home. The bag is designed to vent water and other vapors (including malodorous materials) which emanate from within the bag when used in the manner described herein. The vapors released from the bag are then exhausted through the air vent of the dryer apparatus.

The design of the venting ability of the bag achieves a proper balance of the above effects. A tightly-sealed, vapor impermeable "closed" bag will not purge malodors and will overly moisten the fabrics, resulting in wrinkling. An overly "open" bag design will not sufficiently moisten the fabrics or soils to mobilize heavier malodors or to remove pre-existing fabric wrinkles. Further, the bag must be "closed" enough to billow and create a void volume under water vapor pressure, wherein the fabrics can tumble freely within the bag and be exposed to the vapors.

The preferred venting bags, and methods of using the bags in a non-immersion cleaning and refreshing process, are described in U.S. Pat. No. 5,789,368, to You et al. which was incorporated herein by reference above. Additional disclosure of the bags, methods of using and making the bags, and materials of construction for the bags that are preferred for use in this invention can be found in U.S. Pat. No. 5,762,648, which issued on Jun. 9, 1998, to Yeazell, and in U.S. Pat. No. 5,681,355, which issued on Oct. 28, 1997, to Davis et al. Both the Yeazell patent and the Davis et al. patent are incorporated herein by reference.

More specifically, the preferred vapor-venting containment bags for use in this invention are designed to vent at least about 40%, preferably at least about 60%, up to about 90%, preferably no more than about 80%, by weight, of the total moisture introduced into the bag before the operating cycle of the clothes dryer, or other hot air apparatus, used in the processes herein. The percentage of vapor-venting can be determined from the Vapor-Venting Evaluation Test (VVE) that is defined below, in Example IV. As noted above, the preferred containment bags are designed to achieve a degree of venting, or VVE "score", of at least about 40% (40 VVE), preferably at least about 60% (60 VVE), up to about 90% (90 VVE), even more preferably no more than about 80% (80 VVE).

The following Examples further illustrate the invention, but are not intended to be limiting thereof.

EXAMPLE I

Spot Cleaning Compositions

A spot cleaning composition for use for use in the present invention, preferably with a dispenser as defined above, and with a white terry cloth towel, a TBAL or poly-HIPE foam stain receiver, is prepared as follows:

TABLE IA

| INGREDIENT | % (Wt.) (Nonionic) | Range % (Wt.) |
|---|---|---|
| Hydrogen peroxide | 1.000 | 0.1–4 |
| EDTA* | 0.005 | 0–0.1 |
| Butoxypropoxypropanol (BPP) | 2.000 | 0.1–4 |
| Neodol 23 6.5 | 0.250 | 0.1–1 |
| Kathon preservative | 0.0003 | Optional** |
| Water | 96.710 | Balance |

pH target = 7; range = 6–8
*Stabilizer for hydrogen peroxide
**Sufficient to provide a preservative function.

Another example of a preferred, high water content, low residue spot cleaning composition for use in the pre-spotting step herein is as follows.

TABLE IB

| INGREDIENT | Anionic Composition (%) |
|---|---|
| Hydrogen peroxide | 1.000 |
| EDTA* | 0.04 |
| Butoxypropoxypropanol (BPP) | 2.000 |
| $NH_4$ Coconut $EO_1$Sulfate | 0.285 |
| Dodecyldimethylamine oxide | 0.031 |
| Magnesium chloride | 0.018 |
| Magnesium sulfate | 0.019 |
| Hydrotrope, perfume, other minors, | 0.1 |
| Kathon preservative | 0.0003 |
| Water (deionized or distilled) | 96.507 |
| Target pH | 6.0 |

*Stabilizer for hydrogen peroxide

Another example of a preferred, high water content, low residue spot cleaning composition for use in the pre-spotting step herein is as follows.

TABLE IC

| INGREDIENT | Anionic Composition (%) |
|---|---|
| Hydrogen peroxide | 1.000 |
| EDTA* | 0.04 |
| Butoxypropoxypropanol (BPP) | 2.000 |
| $NH_4$ Coconut Sulfate | 0.285 |
| Dodecyldimethylamine oxide | 0.035 |
| Magnesium chloride | 0.045 |
| Magnesium sulfate | 0.02 |
| Hydrotrope, perfume, other minors, | 0.1 |
| Kathon preservative | 0.0003 |
| Water (deionized or distilled) | 96.5 |
| Target pH | 6.0 |

*Stabilizer for hydrogen peroxide

Preferably, to minimize the potential for dye damage as disclosed hereinabove, $H_2O_2$-containing pre-spotting compositions comprise the anionic or nonionic surfactant in an amount (by weight of composition) which is less than the amount of $H_2O_2$. Preferably, the weight ratio of surfactant:$H_2O_2$ is in the range of from about 1:10 to about 3:1, more preferably from about 1:4 to about 2:1, and most preferably the weight ratio of surfactant:$H_2O_2$ is about 1:1.

EXAMPLE II

Preparation Of A Substrate Comprising A Cleaning/Refreshment Composition

A 10¼ in.×14¼ in. (26 cm×36 cm) substrate in the form of a sheet is prepared from HYDRASPUN® material, manufactured by the Dexter Corp. The substrate sheet is covered on both sides with a topsheet and a bottomsheet of 8 mil (0.2 mm) Reemay fabric coversheet material. The coversheet (i.e., both topsheet and bottomsheet) are bonded to the substrate sheet by a Vertrod® or other standard heat sealer device, such as conventional sonic sealing devices, thereby bonding the laminate structure together around the entire periphery of the sheet. The edges of the sheet around its periphery are intercalated between the topsheet and bottomsheet by the bond. As noted above, the width of the bond is kept to a minimum and is about 0.25 in. (6.4 mm).

The bonded laminate sheet thus prepared is folded and placed in a pouch. Any plastic pouch which does not leak would be suitable. For example, a foil laminated pouch of the type used in the food service industry can be employed. Such pouches are well-known in the industry and are made from materials which do not absorb food flavors. In like manner, the formulator herein may wish to avoid absorption of the perfume used in the cleaning/refreshment composition by the pouch. Various pouches are useful herein and are commercially available on a routine basis.

The folded substrate/coversheet sheet is placed in the pouch. The folds can be of any type, for example, an accordion-style fold or rolled and then the roll is folded in half. This size is not critical but is convenient for placement in a pouch. 23 grams of the cleaning/refreshment composition are poured onto the substrate sheet/coversheet. The composition is allowed to absorb into the substrate. The pouch is sealed immediately after the liquid product is introduced into the pouch and stored until time-of-use.

EXAMPLE III

Cleaning and Refreshing Compositions

Fabric cleaning/refreshment compositions according to the present invention, for use in a containment bag, are prepared as follows:

| Ingredient | % (wt.) |
|---|---|
| Emulsifier (TWEEN 20)* | 0.5 |
| Perfume | 0.5 |
| KATHON ® | 0.0003 |
| Sodium Benzoate | 0.1 |
| Water | Balance |

*Polyoxyethylene (20) sorbitan monolaurate available from ICI Surfactants.

Additionally, preferred compositions for use in the in-dryer cleaning/refreshment step of the process herein are as follows.

| Ingredient | % (wt.) | Range (% wt.) |
|---|---|---|
| Water | 99.0 | 95.1–99.9 |
| Perfume | 0.5 | 0.05–1.5 |
| Surfactant* | 0.5 | 0.05–2.0 |
| Ethanol or Isopropanol | 0 | Optional to 4% |
| Solvent (e.g. BPP) | 0 | Optional to 4% |

pH range from about 6 to about 8.

Besides the other ingredients, the foregoing compositions can contain enzymes to further enhance cleaning performance, as described in the Trinh et al. patent incorporated herein above.

EXAMPLE IV

Vapor Venting Evaluation Test (VVE)

Materials Needed for the VVE Test:

Envelope or "Standard", i.e., Control Containment Bag to be evaluated for VVE.

Carrier Substrate (15"×11"; 38.1 cm×27.9 cm) HYDRASPUN® carrier substrate sheet from Dexter with (10444) or without (10244) Binder.

Wool Blouse: RN77390, Style 12288, Weight approx. 224 grams.

Silk Blouse: RN40787, Style 0161, Weight approx. 81 grams.

Rayon Swatch: 45"×17" (114.3 cm×43.2 cm), Weight approx. 60 grams.

Pouch: 5"×6.375" (12.7 cm×16.2 cm) to contain the Substrate and water.

De-ionized Water; Weight is variable to establish VVE.

Pretreatment of Fabrics:

1. The wool, silk, and rayon materials are placed in a Whirlpool dryer (Model LEC7646DQO) for 10 minutes at high heat setting, with the heating cycle ranging from about 140° F.–165° F. to remove moisture picked up at ambient condition.
2. The fabrics are then removed from the dryer and placed in sealed nylon or plastic bags (minimum 3 mil. thickness) to minimize moisture pick up from the atmosphere.

Test Procedure:

1. Water of various measured weights from 0 to about 40 grams is applied to the substrate a minimum of 30 minutes before running a vented bag test. The substrate is folded, placed in a pouch and sealed.
2. Each fabric is weighed separately and the dry weights are recorded. Weights are also recorded for the dry substrate, the dry pouch containing the substrate, and the dry containment bag being evaluated.
3. Each garment is placed in the bag being evaluated for vapor venting along with the water-containing substrate (removed from its pouch and unfolded).
4. The bag is closed without expressing the air and placed in the Whirlpool Dryer for 30 minutes at the high heat setting, with tumbling per the standard mode of operation of the dryer.
5. At the end of 30 minutes the bag is removed from the dryer and each fabric, the substrate, the bag and the pouch are weighed for water weight gain relative to the dry state. (A possible minor loss in weight for the containment bag due to dryer heat is ignored in the calculations.)
6. The weight gain of each garment is recorded as a percent of the total moisture applied to the substrate.
7. The remaining unmeasured moisture divided by the total moisture is recorded as percent vented from the dryer bag.
8. When a series of total applied moisture levels are evaluated, it is seen that above about 15–20 grams of water the % vented becomes essentially constant, and this is the Vapor-Venting Equilibrium value, or VVE, for the particular bag venting design.

What is claimed is:

1. A method for treating a fabric having a discrete stained area, wherein the fabric has a first side and a second side, the method is characterized by the steps of:

(a) applying a spot cleaning composition to the discrete stained area of the fabric wherein the spot cleaning composition is characterized by, by weight;

(i) from 0.01% to 2.5% of a surfactant selected from the group consisting of anionic, cationic, nonionic, zwitterionic, amphoteric and mixtures thereof;

(ii) from 0.1% to 4%, of a glycol ether solvent;

(iii) from 0.1% to 4% of a bleach;

(iv) from 91% to 99% water;

(b) contacting the first side of the fabric adjacent the stained area with an absorbent stain receiving article;

(c) subjecting the second side of the fabric adjacent the stained area to a heat source;

(d) optionally, concurrently or consecutively with Step (a), contacting the fabric adjacent the stained area with a treatment member; and (e) optionally, applying an aqueous rinsing solution to the fabric adjacent the stained area.

2. The method for treating a fabric according to claim 1, wherein the glycol ether solvent is selected from the group consisting of methoxy propoxy propanal, propoxy propoxy propanol, butoxy propoxy propanol, butoxy propanol and mixtures thereof.

3. The method for treating a fabric according to claim 1, wherein the heat source raises the temperature of the spot cleaning solution on the surface of the fabric to greater than 40° C.

4. The method for treating a fabric according to claim 3, wherein the bleach is hydrogen peroxide.

5. A non-immersion cleaning/refreshment process for treating a fabric having a discrete stained area characterized by the steps of:

(a) placing the fabric in a containment bag;

(b) placing a substrate in the containment bag, wherein releasably absorbed in the substrate is a liquid cleaning/refreshment composition;

(c) placing the bag in a hot air clothes dryer, or the like apparatus, and operating the apparatus with heat and tumbling; and (d) removing the fabric from the bag; and wherein before or after the non-immersion cleaning/refreshment process the discrete stained area of the fabric is treated according to the method of claim 4.

6. The non-immersion cleaning/refreshment process of claim 5, wherein vapors are vented from the bag during step (b).

7. The non-immersion cleaning/refreshment process of claim 6, wherein the containment bag is a vapor-venting bag which has a VVE rating of at least 40 but less than 90 as measured in the Vapor Venting Evaluation Test.

* * * * *